US010992073B1

(12) United States Patent
Probert et al.

(10) Patent No.: US 10,992,073 B1
(45) Date of Patent: Apr. 27, 2021

(54) ELECTRICAL TERMINAL ASSEMBLY WITH INCREASED CONTACT AREA

(71) Applicant: Lear Corporation, Southfield, MI (US)

(72) Inventors: Deborah Probert, Beverly Hills, MI (US); Michael James Porter, Traverse City, MI (US); Jens Lamping, Bersenbrueck (DE); David Menzies, Linden, MI (US); Tulasi Sadras-Ravindra, Canton, MI (US); Michael Glick, Winston-Salem, NC (US); Andrew Fisher, Ortonville, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 16/722,466

(22) Filed: Dec. 20, 2019

(51) Int. Cl.

| | |
|---|---|
| ***H01R 13/11*** | (2006.01) |
| ***H01R 43/16*** | (2006.01) |
| ***H01R 13/08*** | (2006.01) |
| ***H01R 13/18*** | (2006.01) |

(52) U.S. Cl.
CPC ..... *H01R 13/113* (2013.01); *H01R 13/08* (2013.01); *H01R 13/18* (2013.01); *H01R 43/16* (2013.01)

(58) Field of Classification Search
CPC ..... H01R 13/113; H01R 13/08; H01R 13/18; H01R 43/16
USPC ..... 439/607.19
See application file for complete search history.

(56) References Cited

U.S. PATENT DOCUMENTS

| | | | | |
|---|---|---|---|---|
| 4,540,235 | A * | 9/1985 | Lolic | H01R 13/11 439/839 |
| 4,932,877 | A * | 6/1990 | Zinn | H01R 13/18 439/839 |
| 5,035,661 | A * | 7/1991 | Steinhardt | H01R 13/4223 439/839 |
| 5,437,566 | A * | 8/1995 | Zinn | H01R 13/113 439/839 |
| 5,573,434 | A * | 11/1996 | Ittah | H01R 13/113 439/839 |
| 5,591,051 | A * | 1/1997 | Ittah | H01R 13/18 439/752 |
| 5,863,225 | A * | 1/1999 | Liebich | H01R 13/18 439/845 |
| 5,868,590 | A * | 2/1999 | Dobbelaere | H01R 13/18 439/839 |
| 6,659,783 | B2 * | 12/2003 | Copper | H01R 13/53 361/2 |

(Continued)

*Primary Examiner* — Peter G Leigh
(74) *Attorney, Agent, or Firm* — MacMillan, Sobanski & Todd, LLC

(57) ABSTRACT

An electrical connector assembly includes a contact member and a spring member. The contact member has a base and contact arms that extend from the base in an arm direction on opposite sides of a terminal plane. The spring member is supported on the contact member and includes a spring base and spring arms that extend from the spring base in the arm direction. The spring arms are on opposite sides of the terminal plane and engage respective ones of the contact arms at respective spring contacts. The spring member also includes a shroud that is connected to the spring base and has an end shield that extends beyond the arms. The shroud includes side shields that are located on opposite sides of the contact arms and connect the end shield to the spring base. Shield arms also connect the end shield to the spring base.

14 Claims, 7 Drawing Sheets

(56) References Cited

U.S. PATENT DOCUMENTS 6,722,926 B2 * 4/2004 Chevassus-More ..... H01R 13/113 439/721
6,872,103 B1 * 3/2005 Flieger ..... H01R 13/18 439/839
7,252,559 B1 * 8/2007 Morello ..... H01R 4/185 439/843
7,595,715 B2 * 9/2009 Pavlovic ..... H01H 85/0417 337/187
7,892,050 B2 * 2/2011 Pavlovic ..... H01R 13/112 439/839
8,109,794 B2 * 2/2012 Tanaka ..... H01R 12/714 439/630
8,366,497 B2 * 2/2013 Glick ..... H01R 13/187 439/839
8,475,220 B2 * 7/2013 Glick ..... H01R 13/18 439/839
8,951,051 B2 * 2/2015 Natter ..... H01R 13/04 439/149
8,992,270 B2 * 3/2015 Glick ..... H01R 13/187 439/839
8,998,655 B2 * 4/2015 Glick ..... H01R 13/18 439/839
9,011,186 B2 * 4/2015 Wirth ..... H01R 13/112 439/852
9,142,902 B2 * 9/2015 Glick ..... H01R 43/16
9,166,322 B2 * 10/2015 Glick ..... H01R 13/18
9,190,756 B2 * 11/2015 Glick ..... H01R 13/18
9,293,852 B2 * 3/2016 Glick ..... H01R 13/11
9,300,069 B2 * 3/2016 Morello ..... H01R 13/18
9,379,470 B2 * 6/2016 Glick ..... H01R 13/18
9,437,974 B2 * 9/2016 Glick ..... H01R 13/18
9,450,331 B1 * 9/2016 Luo ..... H01R 13/18
9,548,553 B2 * 1/2017 Glick ..... H01R 13/18
9,799,980 B2 * 10/2017 Jakoplic ..... H01R 4/185
9,905,953 B1 * 2/2018 Pavlovic ..... H01R 4/48
10,396,482 B2 8/2019 Glick et al.
10,468,808 B2 * 11/2019 Duan ..... H01R 13/6585
2011/0045712 A1 * 2/2011 Mukuno ..... H01R 4/4881 439/845
2015/0303604 A1 * 10/2015 Rivera ..... H01R 13/113 439/817

* cited by examiner

ELECTRICAL TERMINAL ASSEMBLY WITH INCREASED CONTACT AREA

BACKGROUND OF THE INVENTION

This invention relates to an electrical terminal assembly. More specifically, this invention relates to an electrical terminal assembly that allows a larger contact area with a mating terminal.

Electrical terminal assemblies commonly include a female terminal and a corresponding male terminal that may be mated to establish an electrical connection. It is known to provide a female terminal with a spring member to increase the compression force between the male terminal and the female terminal. An example of one such terminal assembly is shown in U.S. Pat. No. 10,396,482. The spring member is typically made of a material that, compared to the material of a contact member, has inferior electrical conductivity but is less susceptible to relaxation. The spring member maintains the desired compression force without requiring that the size of the contact member be increased and allows the female terminal assembly to maintain a desired contact area with the male terminal, even when the temperature of the female terminal increases.

The terminal assembly shown in the '482 patent includes a spring member with integral front end protection. The spring member includes a cage that extends around and past the contact arms. The cage protects the contact arms from damage during shipping, handling, installation, and use. Because the cage is part of the spring member, no additional pieces are added to the female terminal assembly. It would be desirable to have a terminal assembly that allows for a larger contact area with a corresponding male terminal.

SUMMARY OF THE INVENTION

The invention relates to an electrical terminal assembly. The electrical connector assembly includes a contact member. The contact member has a contact base and a plurality of contact arms that extends from the contact base in an arm direction. The contact arms are arranged on opposite sides of a terminal plane. The electrical connector assembly also includes a spring member. The spring member is supported on the contact member. The spring member includes a spring base and a plurality of spring arms that extends from the spring base in the arm direction. The spring arms are arranged on opposite sides of the terminal plane and engage respective ones of the plurality of contact arms at a spring contact. The spring member also includes a shroud that is connected to the spring base. The shroud extends around the contact arms and beyond the contact arms. The shroud has an end shield that is located in the arm direction beyond the contact arms. The shroud also has side shields that are located on opposite sides of the contact arms and connect the end shield to the spring base. The shroud also includes shield arms that connect the end shield to the spring base.

In another embodiment, the electrical terminal assembly includes an end shield reinforcement.

In another embodiment, the electrical terminal assembly includes terminal guides that extend from the end shield in the arm direction and toward the terminal plane. The terminal guides are spaced apart from each other to define crenels between adjacent terminal guides.

Various aspects of this invention will become apparent to those skilled in the art from the following detailed description of the preferred embodiments, when read in light of the accompanying drawings.

DETAILED DESCRIPTION OF THE PREFERRED EMBODIMENTS

Figure 1:
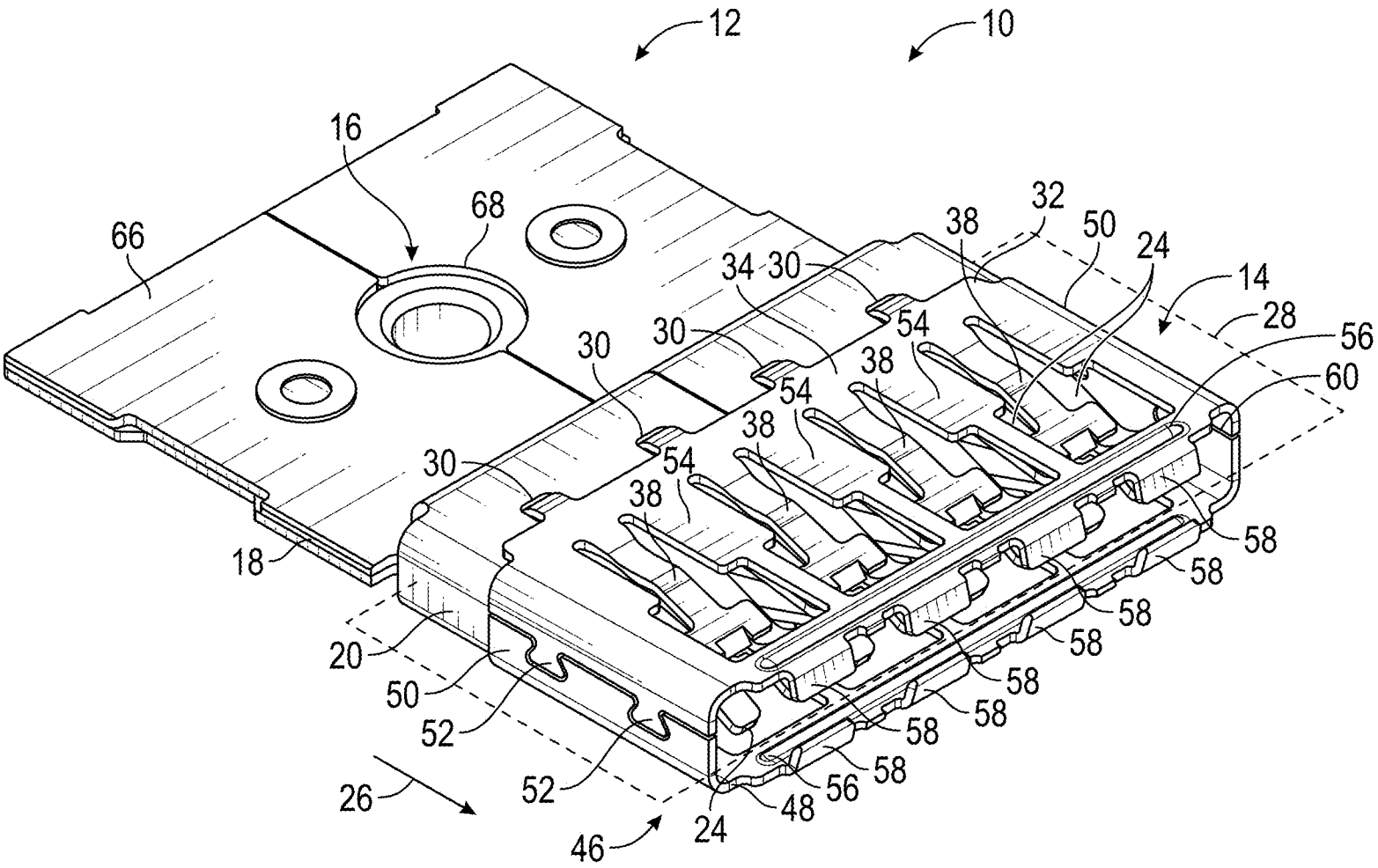
FIG. 1 is a perspective view of a first embodiment of an electrical terminal assembly.
Figure 2:
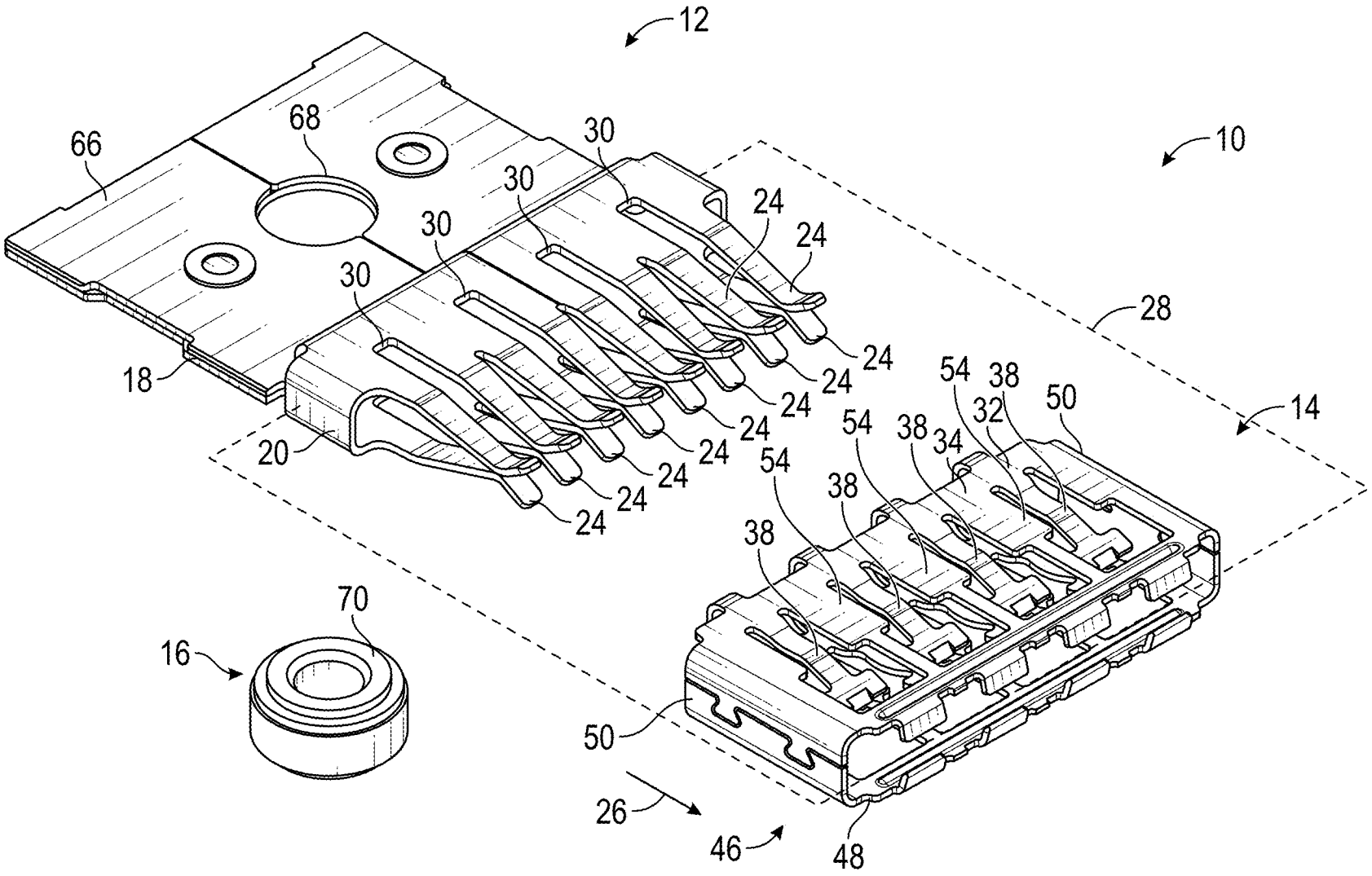
FIG. 2 is an exploded perspective view of the electrical terminal assembly illustrated in FIG. 1.

Referring now to the drawings, there is illustrated in FIG. 1 a perspective view of a first embodiment of an electrical terminal assembly, indicated generally at 10. The electrical terminal assembly 10 includes some features similar to the electrical terminal assembly with a lock spring member described and illustrated in U.S. Pat. No. 10,396,482, the disclosure of which is hereby incorporated by reference. FIG. 2 is an exploded perspective view of the electrical terminal assembly 10, showing separately a contact member, indicated generally at 12, a spring member, indicated generally at 14, and a retainer, indicated generally at 16.

The illustrated contact member 12 is made of a single piece of copper that is stamped and folded into the illustrated shape. However, the contact member 12 may be made of any desired material and may be made by any desired process. The contact member 12 includes a connection portion 18 that will be described in detail below. The contact member 12 also includes a contact base 20 that is connected to the connection portion 18. The illustrated contact base 20 is substantially rectangular cross-sectional in shape. However, the contact base 20 may have any desired shape.

The contact member 12 includes a plurality of contact arms 24 that extends from the contact base 20 in an arm direction 26. In the illustrated embodiment, the connection portion 18 and the contact arms 24 are located on opposite sides of the contact base 20, but these components may have any desired relative orientations. In the illustrated embodiment, the contact member 12 includes eight pairs of contact arms 24, but the contact member 12 may have any desired number and arrangement of contact arms 24. The members of each pair of contact arms 24 are arranged on opposite sides of a terminal plane 28.

The contact member 12 also includes a plurality of spring spaces 30 that are used to position the spring member 14 relative to the contact member 12, as will be described below. The illustrated contact member 12 includes four spring spaces 30 on each side of the terminal plane 28. However, the contact member 12 may have any desired number of spring spaces 30. In the illustrated embodiment, the spring spaces 30 are located between adjacent pairs of contact arms 24 and extend into the contact base 20. However, the spring spaces 30 may be in any desired position on the contact member 12.

The illustrated spring member 14 is made from a single sheet of material that is stamped and folded into the illustrated configuration. However, the spring member 14 may be made by any desired process. The illustrated spring member 14 is made of stainless steel, but may be made of any desired material. Preferably, the spring member 14 is made of a material with good spring characteristics, even at relatively high temperatures.

The spring member 14 includes a spring base 32. The illustrated spring base 32 includes two bridges 34 that are each connected to a plurality of U-shaped struts 36. However, the spring base 32 may have any desired shape. The illustrated spring base 32 includes four struts 36, but may include any desired number. The spring member 14 includes a plurality of spring arms 38 that extend from the spring base 32 in the arm direction 26. In the illustrated embodiment, the spring member 14 includes four pairs of spring arms 38 that extend from the spring base 32 and are arranged on opposite sides of the terminal plane 28. However, the spring member 14 may have any desired number and arrangement of spring arms 38.

Each spring arm 38 extends from the spring base 32 to a respective spring end 40. Each spring arm 38 includes spring contacts 42 that engage the contact arms 24 when the electrical terminal assembly 10 is assembled. Each of the illustrated spring arms 38 includes two spring contacts 42 that extend from opposite sides of the spring arm 38. When the electrical terminal assembly 10 is assembled, each spring contact 42 engages a different contact arm 24 so that each illustrated spring arm 38 engages two contact arms 24.

Figure 5:
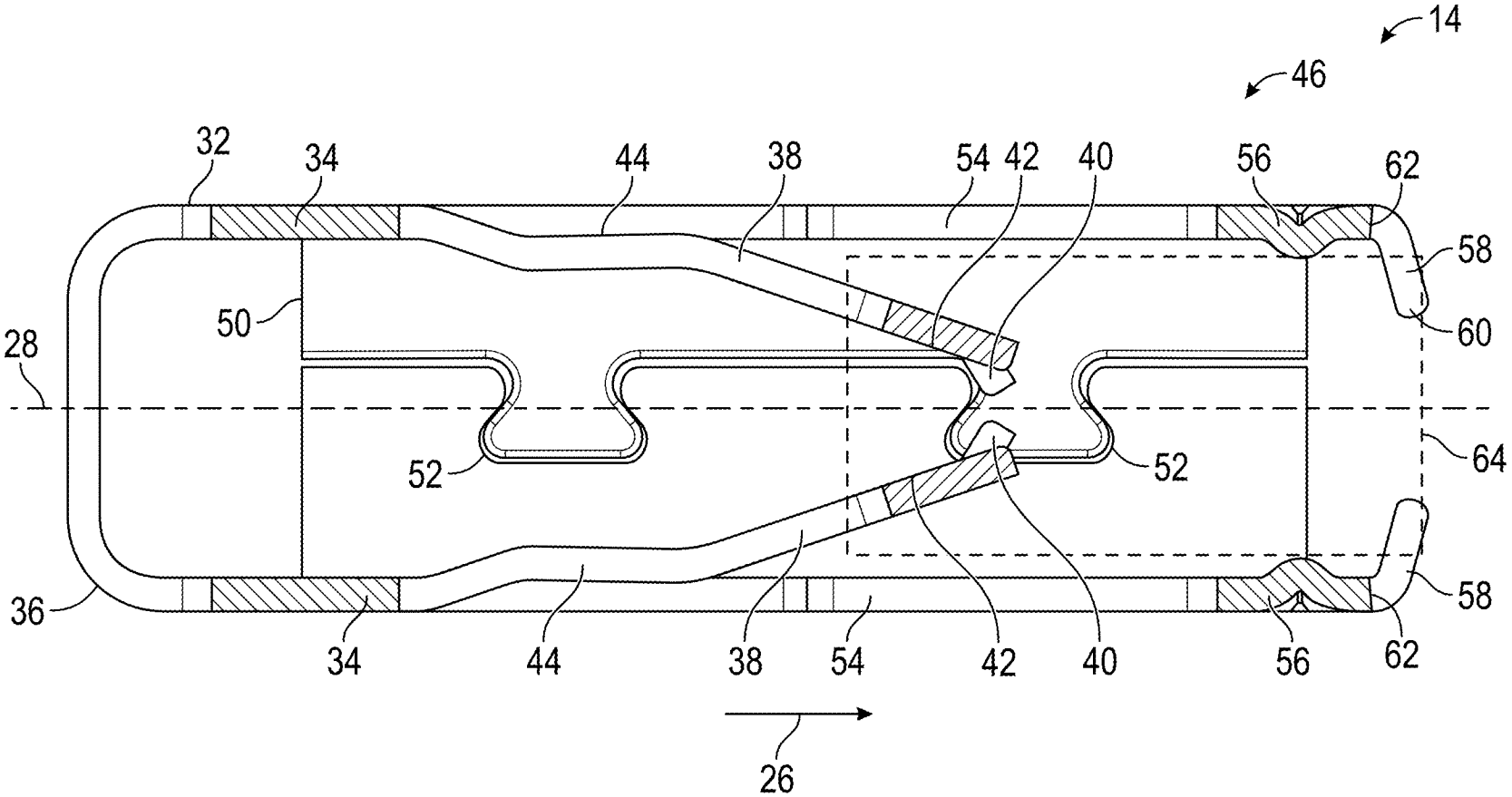
FIG. 5 is a cross-sectional view of the spring member taken along the line 5-5 of FIG. 3.

As best shown in FIG. 5, each spring arm 38 includes a spring arm deflection 44 between the spring base 32 and the spring contacts 42. Each of the illustrated spring arm deflections 44 is a V-shaped portion of the respective spring arm 38 that is bent toward the terminal plane 28. When the electrical terminal assembly 10 is assembled as shown in FIG. 1, the spring arm deflections 44 are located between adjacent contact arms 24.

As best shown in FIG. 2, the spring member 14 includes a shroud, indicated generally at 46. The shroud 46 includes an end shield 48 that is located farther in the arm direction 26 than the spring arms 38. The end shield 48 is connected to the spring base 32 by two side shields 50. The side shields 50 are located on opposite sides of the spring arms 38, and the terminal plane 28 passes through each illustrated side shield 50. In the illustrated embodiment, each side shield 50 includes dovetail locks 52 that hold the spring member 14 in the illustrated shape. However, the spring member 14 may include any desired type of retainer. The illustrated shroud 46 is substantially symmetrical across the terminal plane 28, but may have any desired shape.

Figure 3:
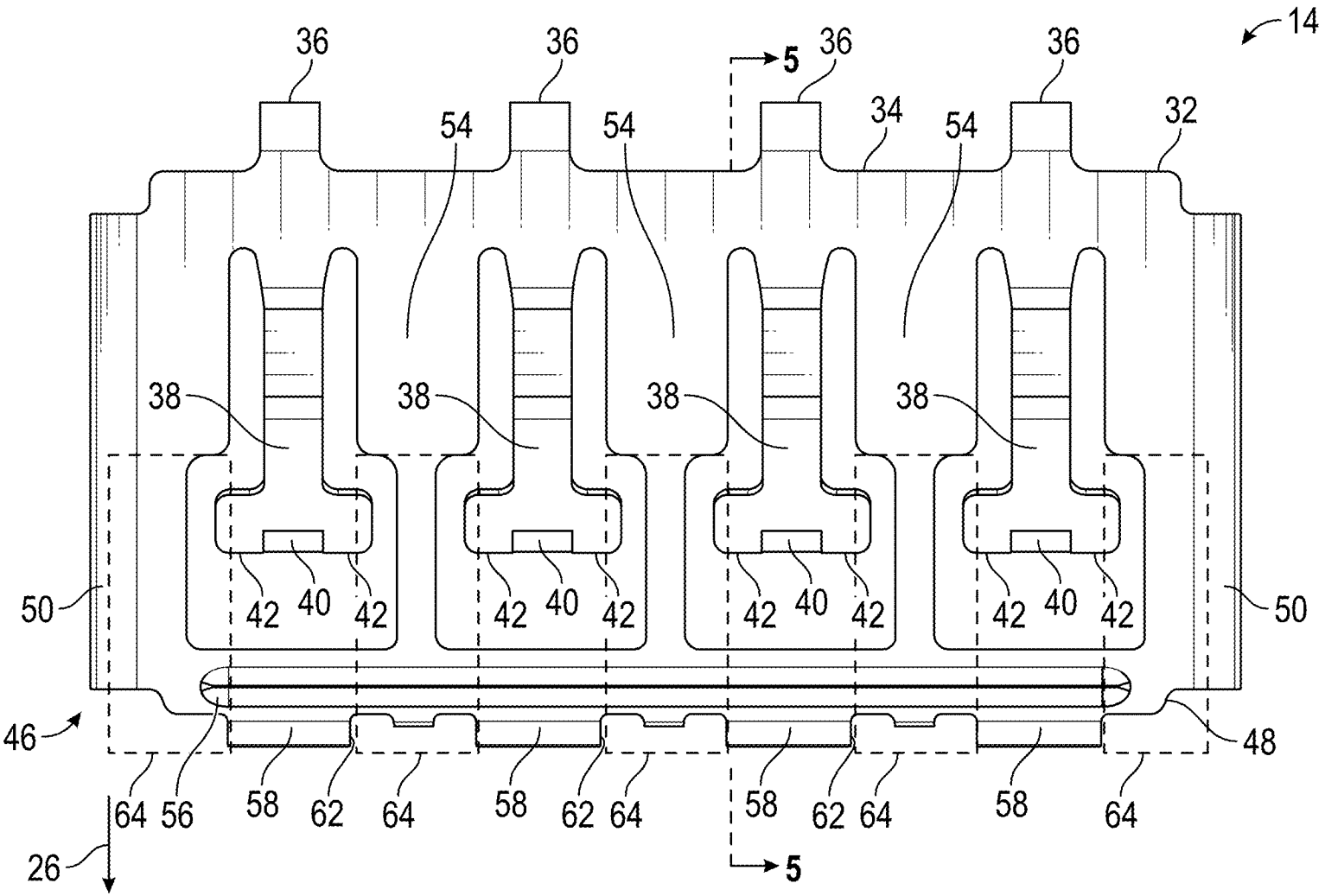
FIG. 3 is a plan view of a spring member from the electrical terminal assembly illustrated in FIGS. 1 and 2.

The spring member 14 includes a plurality of shield arms 54 that extend from the spring base 32 to the end shield 48. The illustrated shield arms 54 extend substantially parallel to the terminal plane 28. However, the shield arms 54 may have any desired orientation. The shield arms 54 are located between the side shields 50. As best shown in FIG. 3, each illustrated shield arm 54 is located between adjacent pairs of spring arms 38. However, the shield arms 54 may be provided in any desired locations.

The spring member 14 also includes an end shield reinforcement 56. The illustrated end shield reinforcement 56 is a portion of the end shield 48 that is embossed, but may, for example, an additional layer of material applied to the end shield 48. As best shown in FIG. 5, the end shield reinforcement 56 extends from the end shield 48 toward the terminal plane 28. Thus, the illustrated end shield reinforcement 56 increases the strength of the end shield 48 without increasing the outer size of the spring member 14. However, the end shield reinforcement 56 may be provided in any desired location.

When the electrical terminal assembly 10 is assembled as shown in FIG. 1, the end shield 48 is located farther in the arm direction 26 than the contact arms 24, and the side shields 50 are located on opposite sides of the contact arms 24. Thus, the shroud 46 extends from the spring base 32 around the contact arms 24 and beyond the contact arms 24 in the arm direction 26.

The spring member 14 includes terminal guides 58 that extend from the end shield 48 in the arm direction 26. The terminal guides 58 serve to protect the contact arms 24 from damage during mating with a corresponding male terminal (not shown). To mate with the electrical terminal assembly 10, the corresponding male terminal is inserted through an insertion opening 60 of the spring member 14. The insertion opening 60 is defined by the end shield 48 and the side shields 50 of the shroud 46. In order to prevent damage to the contact arms 24, it is desirable that the corresponding terminal is inserted at the desired orientation and position relative to the terminal assembly 10. The terminal guides 58 extend from the end shield 48 toward the terminal plane 28 to reduce the size of the insertion opening 60 and thereby prevent the corresponding male terminal from stubbing against the contact arms 24.

The illustrated terminal guides 58 are not continuous. As best shown in FIG. 3, a series of the terminal guides 58 extend from the end shield 48 and are spaced apart from each other to define a series of crenels 62 between adjacent terminal guides 58. The crenels 62 are gaps between the terminal guides 58, and each crenel 62 defines part of a respective tool space 64 that extends parallel to the arm direction 26. The tool spaces 64 extend opposite the arm direction 26, and a portion of at least one of the spring arms 38 extends into each of the tool spaces 64. In the illustrated embodiment, tool spaces 64 are also located between the side shields 50 and the terminal guides 58.

Figure 4:
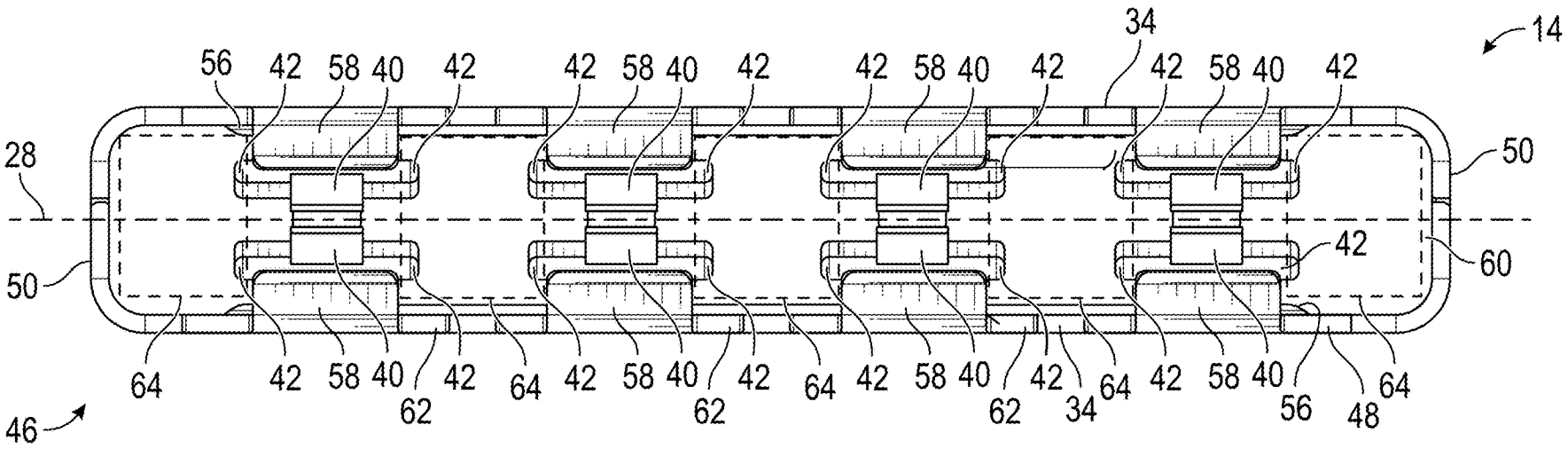
FIG. 4 is a front view of the spring member.

Referring to FIG. 4, a portion of each spring contact 42 on each spring arm 38 is located in a tool space 64. Additionally, each spring contact 42 on a single spring arm 38 is located in a different tool space 64. This allows a tool, such as an arbor (not shown), to be inserted through the insertion opening 60 and engaged with the spring arms 38 in order to push the spring arms 38 farther from the terminal plane 28 than the terminal guides 58 would otherwise allow. In the illustrated embodiment, the tool spaces 64 extend across the terminal plane 28 between the two end shields 48. However, the tool spaces 64 on either side of the terminal plane 28 may be positioned differently from each other, if desired.

In order to attach the assembled spring member 14 to the assembled contact member 12, the tool is used to push the spring arms 38 apart, away from the terminal plane 28. The spring member 14 is then moved relative to the contact member 12 opposite the arm direction 26 so that each of the struts 36 on the spring member 14 is received in one of the spring spaces 30. The spring arms 38 are then released and allowed to rebound so that the spring contacts 42 engage the contact arms 24, and the spring arm deflections 44 are located between adjacent contact arms 24, which helps properly position the spring member 14 relative to the contact member 12. This allows the spring member 14 to be attached to the contact member 12 after the spring member 14 has been assembled, including the side shields 50 being connected by the respective dovetail locks 52.

Compared to the electrical terminal assembly described in U.S. Pat. No. 10,396,482, the electrical terminal assembly 10 is wider and includes a larger number of contact arms 24. This provides for a greater area of contact between the electrical terminal assembly 10 and the corresponding terminal. The shield arms 54 and the end shield reinforcement 56 provide additional strength to the shroud 46 and prevent deflection of the end shield 48 relative to the spring base 32.

Referring back to FIG. 2, the illustrated connection portion 18 is part of the contact member 12 and is made from two layers of material that are laid on top of each other. However, the connection portion 18 may be made of any desired type and arrangement of material. The connection portion 18 includes a connection surface 66. The illustrated connection surface 66 is substantially planar and is located on the connection portion 18 facing the terminal plane 28. However, the connection surface 66 may have any desired shape and be in any desired location.

The connection portion 18 includes a mount hole 68. The mount hole 68 is located generally at the center of the connection surface 66 and extends through both layers of material of the connection portion 18. In the illustrated embodiment, the retainer 16 is a swage nut. When the electrical terminal assembly 10 is assembled, as shown in FIG. 1, a shaft 70 of the retainer 16 is inserted into the mount hole 68.

Figure 6:
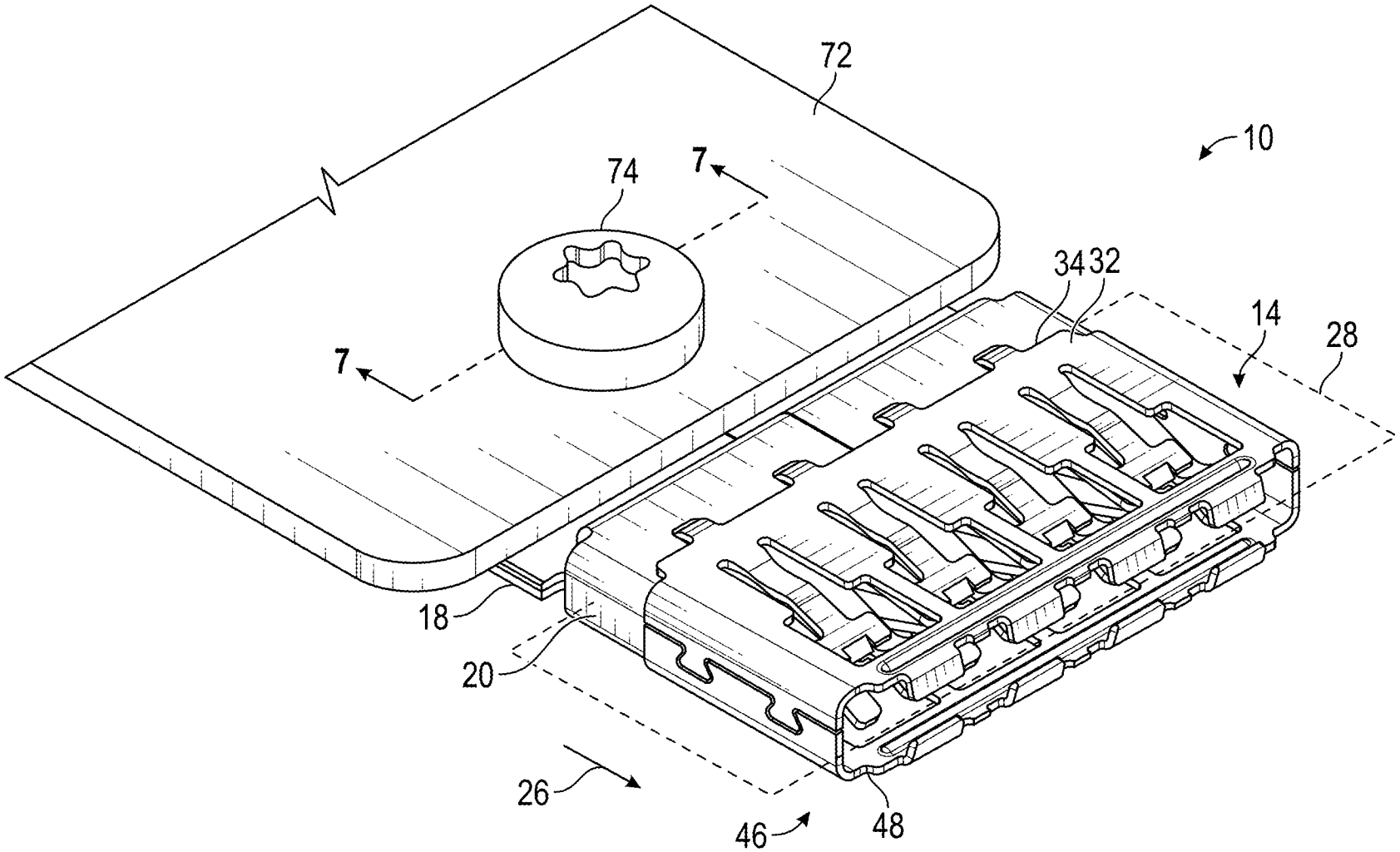
FIG. 6 is a perspective view of the electrical terminal assembly connected to a busbar.

Referring to FIG. 6, a perspective view similar to FIG. 1 is illustrated, with the electrical terminal assembly shown attached to a busbar 72. The busbar 72 is engaged with the electrical terminal assembly 10 to allow electric current to flow between the busbar 72 and the electrical terminal assembly 10. A screw 74 is threaded into the retainer 16 and engages the busbar 72 to retain the busbar 72 in the illustrated position against the connection surface 66.

Figure 7:
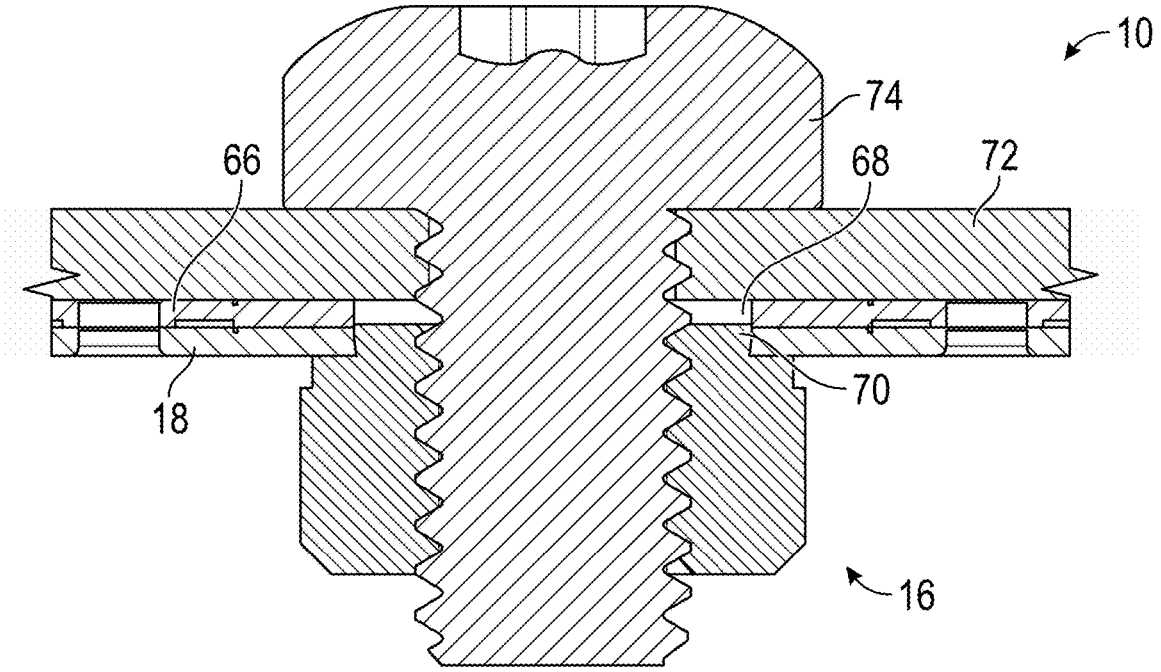
FIG. 7 is a cross-sectional view taken along the line 7-7 of FIG. 6, illustrating the connection of the electrical terminal assembly to the busbar.

Referring to FIG. 7, there is illustrated a cross-sectional view taken along the line 7-7 of FIG. 6. As shown, the screw 74 engages the retainer 16, and the connection portion 18 and the busbar 72 are trapped between the retainer 16 and the screw 74. This maintains contact between the electrical terminal assembly 10 and the busbar 72. In the illustrated embodiment, the shaft 70 of the retainer 16 extends into the mount hole 68 a distance approximately equal to the thickness of one layer of the material of the connection portion 18. However, the shaft 70 may extend any desired distance into the mount hole 68.

Figure 8:
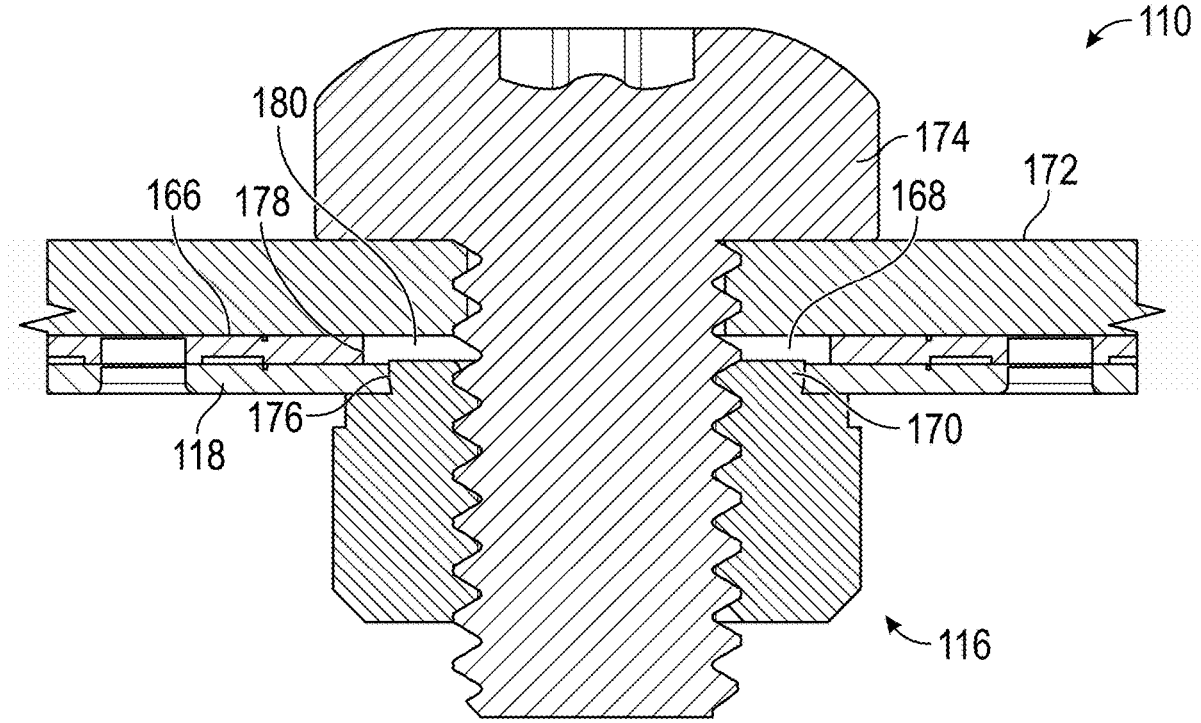
FIG. 8 is a cross-sectional view similar to FIG. 7, illustrating the connection of a second embodiment of an electrical terminal assembly connected to a second busbar.

Referring to FIG. 8, there is illustrated a cross-sectional view similar to FIG. 7, showing a second embodiment of an electrical terminal assembly 110 attached to a second busbar 172. The second embodiment of the electrical terminal assembly 110 is substantially similar to the previously described first embodiment of the electrical terminal assembly 10, and similar features are identified by the same reference number increased by 100. As shown in FIG. 8, the second electrical terminal assembly 110 includes a mount hole 168 that includes two different cross-sectional sizes. The mount hole 168 includes a first portion 176 and a second portion 178. In the illustrated embodiment, both the first portion 176 and the second portion 178 have circular cross-sectional shapes relative to a connection surface 166. However, the first portion 176 and the second portion 178 may have any desired cross-sectional shapes. As shown, the second portion 178 is located closer to the connection surface 166 than the first portion 176. The second portion 178 also has a larger diameter than the first portion 176. In the illustrated embodiment, the first portion 176 of the mount hole 168 is punched through a first layer of material of a connection portion 118, and the second portion of the mount hole 168 is punched through a second layer of material of the connection portion 118.

As shown, a shaft 170 of a retainer 116 extends into the mount hole 168 through the first portion 176. The larger second portion 178 provides a deflection space 180 between the retainer 116 and the busbar 172. The deflection space 180 provides room for the deformation of the material of the connection portion 118 during the attachment of the electrical terminal assembly 110 to the busbar 172.

The illustrated embodiments have been described with the use of swage nuts as the retainers 16 and 116, but the electrical terminal assemblies 10 and 110 may use any desired type of connection. For example, the electrical terminal assembly 10 may not include the mount hole 68 and may be welded to the busbar 72. Additionally, the illustrated embodiments have been described in connection with the busbars 72 and 172, but the electrical terminal assemblies 10 and 110 may be connected to any desired type of conductor.

The principle and mode of operation of this invention have been explained and illustrated in its preferred embodiments. However, it must be understood that this invention may be practiced otherwise than as specifically explained and illustrated without departing from its spirit or scope.

What is claimed is:

1. An electrical terminal assembly comprising:

a contact member including a contact base having contact arms that extend from the contact base in an arm direction and are arranged on opposite sides of a terminal plane; and a spring member supported on the contact member including a spring base, spring arms that extend from the spring base in the arm direction on opposite sides of the terminal plane into engagement with the contact arms at respective spring contacts, and a shroud that is connected to the spring base and extends around the contact arms and beyond the contact arms in the arm direction, the shroud including:

an end shield that is located in the arm direction beyond the contact arms, side shields located on opposite sides of the contact arms that connect the end shield to the spring base, shield arms that connect the end shield to the spring base, and terminal guides that extend from the end shield in the arm direction and toward the terminal plane, wherein the terminal guides are spaced apart from each other to define crenels between adjacent terminal guides.

2. The electrical terminal assembly of claim 1, wherein the shield arms extend substantially parallel to the terminal plane.

3. The electrical terminal assembly of claim 1, wherein the shield arms are located between the side shields.

4. The electrical terminal assembly of claim 1, wherein the shield arms are located on opposite sides of the terminal plane.

5. The electrical terminal assembly of claim 1, wherein the end shield includes an end shield reinforcement.

6. The electrical terminal assembly of claim 5, wherein the end shield reinforcement extends from the end shield toward the terminal plane.

7. The electrical terminal assembly of claim 6, wherein the crenels define tool spaces that extend parallel to the arm direction, and wherein each spring arm is located at least partially in one of the tool spaces.

8. An electrical terminal assembly comprising:

a contact member including a contact base having contact arms that extend from the contact base in an arm direction and are arranged on opposite sides of a terminal plane; and a spring member supported on the contact member including a spring base, spring arms that extend from the spring base in the arm direction on opposite sides of the terminal plane into engagement with the contact arms at respective spring contacts, and a shroud that is connected to the spring base and extends around the contact arms and beyond the contact arms in the arm direction the shroud including:

an end shield that is located in the arm direction beyond the contact arms and includes an end shield reinforcement, terminal guides that extend from the end shield in the arm direction and toward the terminal plane, wherein the terminal guides are spaced apart from each other to define crenels between adjacent terminal guides, the crenels define tool spaces extending parallel to the arm direction, and each spring arm is located at least partially in one of the tool spaces.

9. The electrical terminal assembly of claim 8, wherein the end shield reinforcement extends from the end shield toward the terminal plane.

10. An electrical terminal assembly comprising:

a contact member including a contact base having contact arms that extend from the contact base in an arm direction on opposite sides of a terminal plane; and a spring member supported on the contact member including a spring base, spring arms that extend from the spring base in the arm direction on opposite sides of the terminal plane into engagement with the contact arms at respective spring contacts, and a shroud that is connected to the spring base and extends around the contact arms and beyond the contact arms in the arm direction the shroud including:

an end shield that is located in the arm direction beyond the contact arms, and terminal guides that extend from the end shield in the arm direction and toward the terminal plane, wherein the terminal guides are spaced apart from each other to define crenels between adjacent terminal guides, the crenels define tool spaces extending parallel to the arm direction, and each spring arm is located at least partially in one of the tool spaces.

11. The electrical terminal assembly of claim 10, wherein the shroud includes side shields located on opposite sides of the contact arms that connect the end shield to the spring base and shield arms that connect the end shield to the spring base.

12. The electrical terminal assembly of claim 11, wherein the shield arms extend substantially parallel to the terminal plane.

13. The electrical terminal assembly of claim 11, wherein the shield arms are located between the side shields.

14. The electrical terminal assembly of claim 11, wherein the shroud includes shield arms located on opposite sides of the terminal plane.

* * * * *